United States Patent [19]

Lind et al.

[11] 4,252,880

[45] Feb. 24, 1981

[54] ELECTROPHOTOGRAPHIC RECORDING MATERIAL

[75] Inventors: Erwin Lind; Franz Freimuth, both of Wiesbaden, Fed. Rep. of Germany

[73] Assignee: Hoechst Aktiengesellschaft, Fed. Rep. of Germany

[21] Appl. No.: 31,971

[22] Filed: Apr. 20, 1979

[30] Foreign Application Priority Data

Apr. 21, 1978 [DE] Fed. Rep. of Germany ..... 2817428

[51] Int. Cl.[3] ..... G03G 5/04; G03G 5/09

[52] U.S. Cl. ..... 430/82; 430/83

[58] Field of Search ..... 430/82, 83, 42, 46

[56] References Cited

U.S. PATENT DOCUMENTS

| | | | |
|---|---|---|---|
| 3,796,569 | 3/1974 | Kondo et al. | 430/82 |
| 4,025,340 | 5/1977 | Takimoto et al. | 430/83 |
| 4,063,948 | 12/1977 | Lind | 430/83 |

FOREIGN PATENT DOCUMENTS

| | | | |
|---|---|---|---|
| 1302986 | 6/1971 | Fed. Rep. of Germany | 430/83 |

*Primary Examiner*—Mary F. Downey

*Attorney, Agent, or Firm*—James E. Bryan

[57] ABSTRACT

This invention relates to an improvement in an electrophotographic recording material comprising an electrically conductive support, in particular a support adapted for the preparation of printing forms or printed circuits, and a panchromatically sensitized photoconductive layer which comprises an organic photoconductor, a binder, a sensitizing dye, and conventional additives, the improvement that the photoconductive layer contains, as the sensitizing dye, a mixture of a polymethine dye and a triarylmethane dye which absorb, respectively, between about 400 and 550 nm and between about 550 nm and 720 nm.

4 Claims, 1 Drawing Figure

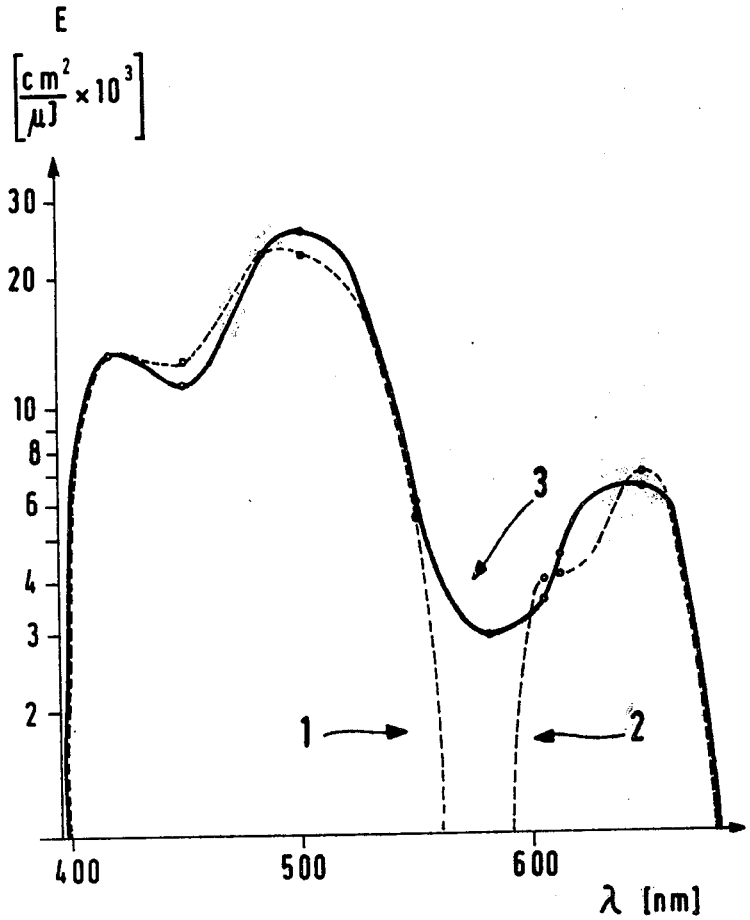
E
[cm²/μJ × 10³]
30
20
10
8
6
4
3
2
1
2
3
400
500
600
λ [nm]

ELECTROPHOTOGRAPHIC RECORDING MATERIAL

The present invention relates to an electrophotographic recording material comprising an electrically conductive support, in particular a support adapted for the preparation of printing forms or printed circuits, and a panchromatically sensitized photoconductive layer which comprises an organic photoconductor, a binder, a sensitizing dye, and conventional additives.

It is known, from German Patent Application No. R 16 768 IVa/57b, published on Sept. 20, 1956, to use photoconductors for electrophotographic reproduction which are sensitive to radiation within a range of 375 to 390 nm and whose radiation sensitivity may be extended into the visible range of the spectrum by adding a dye or a mixture of dyes capable of absorbing radiated energy and of transferring it to the photoconductor. Such dyes include dyes of very different classes of compounds, such as phthalein dyes, triphenylmethane dyes, cyanine dyes, heterocyclic dyes, and unclassified dyes.

Further, it is known from German Offenlegungsschrift No. 1,447,907, that photoconductor layers can be sensitized panchromatically, i.e. over the entire visible range of the spectrum, by adding a combination of several dyes. For this purpose, mixtures of Acridine Yellow (C.I. 46,025), Acridine Orange (C.I. 46,005), Rhodamine B (C.I. 45,170), and Brilliant Green (C.I. 42,040) are used, a relatively uniform sensitization between about 400 and 700 nm being thus achieved, because the selective sensitizing effects of the individual dyes combine to produce a panchromatic sensitivity.

Furthermore, it is known from German Offenlegungsschrift No. 2,353,639, to panchromatically sensitize an electrophotographic recording material comprising a photoconductive multi-layer system by forming a dyestuff layer from at least two pigment dyes which absorb in different ranges of the spectrum, at shorter and longer wave lengths.

Of these materials, the first has the disadvantage that a relatively large number of dyes must be used which are not always compatible with each other, whereas, in the case of the second material, pigment dyes are used which must be applied as a separate layer which—due to its desired characteristics—can only incompletely be removed or cannot be removed and must be applied to the support in most cases by high-vacuum vapor deposition.

Further, it is known from German Auslegeschrift No. 2,526,720, to use, for electrophotographic reproduction, an electrophotographic material which contains in its photoconductive layer a cyanine dye with an absorption maximum between 400 and 550 nm. Such a material, however, is sensitive only in the near absorption range of the photoconductor itself, i.e. within the blue spectral range.

It is the object of the present invention to provide an electrophotographic recording material which is panchromatically sensitized, can be easily prepared and handled, has a uniform good sensitivity over the entire visible range of the spectrum, and thus allows the manufacture of excellent reproductions.

This object is achieved by an electrophotographic recording material which comprises an electrically conductive support and a panchromatically sensitized photoconductive layer comprising an organic photoconductor, a binder, a sensitizing dye, and conventional additives. The photoconductive layer comprises, as the sensitizing dye, a mixture of a polymethine dye and a triarylmethane dye which absorb, respectively, between about 400 and 550 nm and between about 550 and 720 nm. The recording material according to the present invention is of particular advantage if, for further processing of the imaged photoconductive layer, the non-image areas must be decoated, as is the case in the preparation of printing forms and printed circuits.

It was surprising that a uniform panchromatic sensitivity of a photoconductor layer can be achieved by using only two sensitizing dyes, one of them selected from the group of polymethine dyes with an absorption between about 400 and 550 nm, and the other selected from the group of triarylmethane dyes with an absorption between about 550 and 720 nm.

Upon investigating the sensitizing effect of the individual components, it was found that their sensitivity declines significantly in the spectral range around 550 nm. On the other hand, if two components, i.e. one from each group, are combined and the spectral sensitivity curve is examined, it is found that the sensitivity around 550 nm is higher than anticipated and approaches the maxima of the two individual components. The distinct sensitivity minimum to be expected in the overlapping region of the two dye components does not occur.

This surprising interrelation can be seen from the accompanying FIG. 1 in which the spectral sensitivity (E) of the photoconductive layer is plotted against the wave length for a discharge from −400 Volts ($U_O$) to −50 Volts (U), the investigated dyes being Astrazon Orange R (1), Brilliant Green (2), and a mixture of the two (3). This observation is confirmed if, to the above described mixture, a third dye is added which sensitizes in the spectral range around 550 nm. It is found that practically no increase of the sensitivity within this range can be achieved by the third dye.

By using only two water-soluble sensitizing dyes, the preparation of panchromatically sensitized photoconductor layers is considerably simplified. In many cases—depending upon the type of photoconductor used—it is even possible to reduce the quantity of the dyes used. Because most sensitizing dyes are salts which by their presence in the photoconductor layer produce a certain dark conductivity, the use of a smaller quantity frequently causes an improvement of the electrophotographic properties of the layer. Panchromatic sensitization in itself has the advantage that better use is made of the light emitted by the light sources normally used in the reproduction field. In practice, this means shorter exposure times and thus savings in time and energy. Because of these improved properties, it is also possible to reduce the photoconductor content of the photoconductive layer.

From the group of polymethine dyes with an absorption between about 400 and 550 nm which are to be used in accordance with the invention, the following are preferred: Astrazon Yellow 3GL (C.I. 48,055), Astrazon Yellow 5G (C.I. 48,065), Basic Yellow 52,115 (C.I. 48,060), Astrazon Yellow GRL (C.I. Basic Yellow 29), Astrazon Yellow 7GLL (C.I. Basic Yellow 21), Astra Yellow R (C.I. Basic Yellow 44), Astrazon Orange G (C.I. 48,035), Astrazon Orange R (C.I. 48,040), and Astrazon Orange 3RL (C.I. Basic Orange 27).

From the group of triarylmethane dyes absorbing within the spectral range from 550 to 720 nm to be used according to the present invention, the following are preferred: Malachite Green (C.I. 42,000), Brilliant Green (C.I. 42,040), Acid Violet 6BNOO (C.I. 42,552), Crystal Violet (C.I. 42,555), Fanal Blue RM (C.I. 42,600), Chromoxane Pure Blue BA (C.I. 43,830), Naphthalene Green V (C.I. 44,025), Victoria Pure Blue B (C.I. 42,595), and Wool Fast Blue FGL (C.I. 44,505).

Preferably, sensitizing mixtures are employed which contain Astrazon Orange R as the polymethine dye, and Brilliant Green, Crystal Violet, or Victoria Pure Blue B as the triarylmethane dye.

The mixing ratio of the two sensitizing dyes is variable and may depend, e.g., on the light source used in the copying apparatus, on the absorption range of the photoconductor, and on the type of the sensitizer. Thus, the ratio of the two sensitizers may vary within wide limits. By selecting a special mixture, it is possible, e.g., to adapt the spectral range of the photoconductive layer to the type of lamp used in the copying apparatus. For use with conventional halogen-tungsten lamps, and in view of the increasing emission of these lamps in the red spectral range, a photoconductor layer is of advantage which has a relatively high or increasing sensitivity in the short wave range of the spectrum.

Although the mixing ratio of the dyes is not critical, sensitizing mixtures are normally preferred which contain between about 25 to 90 percent by weight of a polymethine dye, calculated on the weight of the mixture.

The proportion by weight of the sensitizing mixture in the photoconductive layer also may vary and depends mainly on the sensitivity which is desired or required. As a rule, the quantity of the dye mixture will range from about 0.5 to about 0.001 percent by weight of the weight of the photoconductor present.

Monomeric and polymeric, aromatic and heterocyclic compounds may be used as organic photoconductors. Among the monomeric compounds, heterocyclic compounds such as the oxadiazole derivatives disclosed in German Pat. No. 1.058,836, are preferred. They include, in particular, 2,5-bis-(p-diethylaminophenyl)-oxadiazole-1,3,4. Other monomeric photoconductive compounds which may be used are, e.g., triphenylamine derivatives, relatively highly condensed aromatic compounds, e.g. anthracene, benzo-condensed heterocyclic compounds and pyrazoline and imidazole derivatives, including the triazole and oxazole derivatives disclosed in German Pat. Nos. 1,060,260, and No. 1,120,875.

Suitable polymeric compounds are, e.g., aromatic vinyl polymers, e.g. polyvinyl anthracene and polyacenaphthylene, or copolymers thereof. Poly-N-vinylcarbazole or copolymers of N-vinyl-carbazole with an N-vinyl-carbazole content of at least 40% have proved particularly advantageous. Condensation products of formaldehyde with various aromatic compounds, e.g. condensates of formaldehyde with 3-bromo-pyrene, were also found to be suitable.

Natural or synthetic resins may be used as binders to influence the flexibility, the film-forming properties, and the adhesion of the layers. Polyester resins, e.g. copolyesters of iso- and terephthalic acid with glycol, are particularly suitable. Silicone resins, e.g. three-dimensionally cross-linked phenyl-methylsiloxanes or the so-called "reactive" resins known under the designation "DD-lacquers", also have proved to be suitable. Copolymers of styrene and maleic acid anhydride and polycarbonate resins also may be used with advantage.

The ratio between binder and photoconductor in the photoconductive layer may vary. If the layer contains monomeric photoconductors, the proportion of binder usually will be higher and may even exceed 50 percent, although a ratio of about 1:1 is preferred. If polymeric photoconductors are contained in the layer, the binder may be omitted.

Depending upon the purpose for which the material is to be used, metal foils or plates, plastic films made superficially conductive, or specially prepared, solvent-impermeable papers which were rendered electrically conductive may be used as supporting materials for the panchromatically sensitized photoconductor layers according to the invention. Plastic films made superficially conductive are used if an electrophotographic film material is to be prepared from the panchromatically sensitized layer. If the material sensitized in accordance with the invention is to be used for office copying, paper is used as the support.

If the process according to the invention is to be used for the preparation of printing forms, metallic supports, especially aluminum supports, are used. Advantageously, the aluminum plates used are superficially roughened by a mechanical or electrochemical treatment; in special cases, they also may be anodized.

Conventional additives, which may be added to the electrophotographic recording material according to the invention are levelling agents and plasticizers, which may be contained in the photoconductive layer, and/or adhesion promoters, which may be disposed between the support and the photoconductive layer.

The invention will be further illustrated by a comparative example and by the following Examples 1 to 3.

First, a panchromatic layer is prepared as described in Example 2 of German Offenlegungsschrift No. 1,447,907. For this purpose, 2 g of 2,5-bis-(p-diethylaminophenyl)-1,3,4-oxadiazole and 2 g of a copolymer of styrene and maleic acid anhydride are dissolved in 40 g of ethyleneglycol monomethyl ether, and a solution of 2 mg of Acridine Yellow G (C.I. 46,025), 2 mg of Acridine Orange (C.I. 46,005), 1 mg of Rhodamine B extra (C.I. 45,170), and 1 mg of Brilliant Green (C.I. 42,040) in 3 ml of methanol is added to the solution. The combined solution is applied to an aluminum plate and the solvent is evaporated. In this manner, a panchromatic layer is produced. The layer is charged in the absence of light to a potential of −400 Volts and the energy required to discharge it to −50 Volts is measured. The following values were found: 139 $\mu J/cm^2$ at 487 nm, 177 $\mu J/cm^2$ at 505 nm, 172 $\mu J/cm^2$ at 532 nm, 165 $\mu J/cm^2$ at 552 nm, and 195 $\mu J/cm^2$ at 650 nm.

The comparison layer is produced by adding to the above-described solution of photoconductor and binder, instead of the 4 dyes mentioned above, 5 mg of Astrazon Orange R (C.I. 48,040) and 1 mg of Brilliant Green (C.I. 42,040), i.e. a composition which corresponds to the material used for Curve 3 in the drawing.

When the resulting layer is charged to a potential of −400 Volts in the absence of light and then discharged to −50 Volts, the following energies are required: 45 $\mu J/cm^2$ at 487 nm, 41 $\mu J/cm^2$ at 505 nm, 62 $\mu J/cm^2$ at 532 nm, 168 $\mu J/cm^2$ at 552 nm, and 156 $\mu J/cm^2$ at 650 nm.

EXAMPLE 1

200 mg of Astrazon Orange R (C.I. 48,040), and 40 mg of Brilliant Green (C.I. 42,040) are added, as sensitizers, to a solution of 4 g of 2-vinyl-4-(2'-chlorophenyl)-5-(4'-diethylaminophenyl) oxazole and 9 g of a copolymer of styrene and maleic anhydride in a mixture composed of 45 g of ethyleneglycol monomethyl ether, 20 g of butyl acetate (85 percent), and 70 g of tetrahydrofuran. The resulting solution is applied to an electrochemically roughened and anodized aluminum plate which had been after-treated with polyvinyl phosphonic acid as described in German Offenlegungsschrift No. 1,621,478. After evaporation of the solvents, a photoconductor layer is obtained which is sensitive in the spectral range between 400 and 700 nm and which is used in the following manner for the production of an offset printing form:

In the absence of light, the layer is charged by a corona to a potential of −430 Volts and is then exposed for 10 seconds in a camera at stop 14, 10 metal halide radiators of 600 watts output each being used as the light source. The latent charge image thus produced is developed by applying a toner powder with the aid of a magnetic roll. The toner image is fixed by the action of heat. After removal of the photoconductor layer in the areas not covered by the toner, by means of a solution produced by dissolving 50 g of $Na_2SiO_3.9H_2O$ in 250 g of glycerol (86 percent) and diluting the resulting solution with 390 g of ethyleneglycol and 310 g of methanol, a planographic printing form is obtained from which very long runs may be printed.

EXAMPLE 2

A panchromatic photoconductor layer for the preparation of a small offset printing form is produced by adding 250 mg of Astra Yellow R (C.I. Basic Yellow 44) and 50 mg of Victoria Pure Blue B (C.I. 42,595) to a solution of 5 g of 2,5-bis-(p-diethylaminophenyl)-1,3,4-oxadiazole and 5 g of a styrene/maleic anhydride copolymer in a mixture of 62 g of ethyleneglycol monomethyl ether, 15 g of butyl acetate (85 percent), and 13 g of butanone, and applying the solution to the mechanically roughened surface of a 100 μm thick aluminum plate in a manner such that an about 5 μm thick layer results after evaporation of the solvent.

In the absence of light, the layer is charged to a potential of −400 Volts and is then exposed for 20 seconds at stop 11 in a camera, 8 incandescent lamps of 500 watts each being used as the light source. The latent charge image thus produced is developed with a light developer described in British Pat. No. 1,465,926. For this purpose, 1.5 g of a high-vacuum bitumen with a softening range of 130°–140° C. is dispersed in a solution of 6.5 g of a pentaerythritol resin ester in 1,000 ml of an isoparaffin with a boiling range between 185° and 210° C. After development, the photoconductor layer is removed in the image-free areas with the solution used in Example 1. A printing plate for small offset printing is thus obtained whose mechanical strength allows printing runs of 60,000 to 80,000 copies.

EXAMPLE 3

For the preparation of a panchromatically sensitive layer for an electrophotographic film material, 21 g of polyvinyl carbazole is dissolved in a mixture of 150 g of toluene, 75 g of tetrahydrofuran, and 75 g of dimethyl formamide. The solution is mixed with 21 mg of Crystal Violet (C.I. 42,555) and 7 mg of Astrazone Orange R (C.I. 48,040) and is then applied to a polyester film which had been made superficially conductive by vapor deposition of an indium/tin oxide layer. After evaporation of the solvents, a panchromatic film material is obtained which may be used as an electrophotographic duplicating film.

For this purpose, the film is charged in the absence of light to a surface potential of −400 Volts and is then exposed for 10 seconds in contact with a negative film to a 100 watt lamp from a distance of 65 cm. The charge image is developed with a commercially available developer containing negatively charged developer particles. A positive film copy with good contrast is thus obtained which has a high resolving power.

It will be obvious to those skilled in the art that many modifications may be made within the scope of the present invention without departing from the spirit thereof, and the invention includes all such modifications.

What is claimed is:

1. In an electrophotograhic recording material comprising an electrically conductive support, in particular a support adapted for the preparation of printing forms or printed circuits, and a panchromatically sensitized photoconductive layer which comprises an organic photoconductor, a binder, a sensitizing dye, and conventional additives, the improvement that the photoconductive layer contains, as the sensitizing dye, a mixture of a polymethine dye and a triarylmethane dye which absorb, respectively, between about 400 and 550 nm and between about 550 nm and 720 nm, said polymethine dye being selected from the group consisting of Astrazon Orange R (C.I. 48,040), Astrazon Orange G (C.I. 48,035), Astrazon Yellow 3 GL (C.I. 48,055), Astrazon Yellow 5G (C.I. 48,065), Basic Yellow 52,115 (C.I. 48,060), Aztrazon Yellow GRL (C.I. Basic Yellow 29), Astrazon Yellow 7GLL (C.I. Basic Yellow 21), Astra Yellow R (C.I. Basic Yellow 44), and/or Astrazon Orange 3RL (C.I. Basic Orange 27).

2. A recording material according to claim 1 in which the photoconductive layer contains, as the triarylmethane dye, Malachite Green (C.I. 42,000), Brilliant Green (C.I. 42,040), Acid Violet 6BNOO (C.I. 42,552), Crystal Violet (C.I. 42,555), Fanal Blue RM (C.I. 42,600), Chromoxane Pure Blue BA (C.I. 43,830), Naphthalene Green V (C.I. 44,025), Victoria Pure Blue B (C.I. 42,595), and/or Wool Fast Blue FGL (C.I. 44,505).

3. A recording material according to claim 1 in which the photoconductive layer contains Astrazon Orange R and Brilliant Green or Crystal Violet or Victoria Pure Blue B as sensitizing dyes.

4. A recording material according to claim 1 in which the mixture of sensitizing dyes contains between about 25 and 90 percent by weight of a polymethine dye, calculated on the weight of the mixture.

* * * * *